US006871369B1

(12) United States Patent
Long

(10) Patent No.: US 6,871,369 B1
(45) Date of Patent: Mar. 29, 2005

(54) DEVICE FOR CORRECTING SAGGING BEDS

(76) Inventor: Kevin John Long, 32 Squankum Rd., Colts Neck, NJ (US) 07722

( * ) Notice: Subject to any disclaimer, the term of this patent is extended or adjusted under 35 U.S.C. 154(b) by 0 days.

(21) Appl. No.: 10/838,756

(22) Filed: May 4, 2004

(51) Int. Cl.[7] ..... A47C 21/06
(52) U.S. Cl. ..... 5/659; 5/655.9
(58) Field of Search ..... 5/659, 658, 655.9, 5/652, 953

(56) References Cited

U.S. PATENT DOCUMENTS

| | | | | | |
|---|---|---|---|---|---|
| 1,742,108 | A | * | 12/1929 | Taylor | 5/659 |
| 2,010,766 | A | * | 8/1935 | Longfellow | 5/659 |
| 2,462,004 | A | * | 2/1949 | Rothery | 5/655.9 |
| 2,545,310 | A | * | 3/1951 | Roseberger | 5/658 |
| 2,861,278 | A | * | 11/1958 | Young | 5/659 |
| 3,751,742 | A | * | 8/1973 | Worley | 5/659 |
| 3,806,968 | A | * | 4/1974 | Robey | 5/660 |
| 4,731,891 | A | * | 3/1988 | Scheurer et al. | 5/636 |
| 4,745,645 | A | * | 5/1988 | McWilliams | 5/659 |
| 5,070,559 | A | * | 12/1991 | Pettifer | 5/659 |
| 5,754,998 | A | * | 5/1998 | Selton | 5/652 |
| 5,910,080 | A | * | 6/1999 | Selton | 5/652 |
| 6,081,950 | A | * | 7/2000 | Selton | 5/652 |
| 6,665,898 | B2 | * | 12/2003 | Gordon | 5/659 |
| 2003/0101515 | A1 | * | 6/2003 | Gordon | 5/659 |

* cited by examiner

*Primary Examiner*—Robert G. Santos

(57) ABSTRACT

A kit composed of several thin approximately paraboloid shaped foam inserts (14) of various thickness (20, 22 and 24), firmness (30, 32 and 34) and base size (40, 42 and 44) adapted for correcting the contour of a sagging mattress (11) and box spring (12) and, modifying the mattress (11) top firmness. One, or more, inserts (14) are inserted between the box spring (12) and mattress (11) and/or placed on top of mattress (11) until desired comfort is achieved.

20 Claims, 8 Drawing Sheets

DEVICE FOR CORRECTING SAGGING BEDS

CROSS-REFERENCE TO RELATED APPLICATIONS

Not Applicable

FEDERALLY SPONSERED RESEARCH

Not Applicable

SEQUENCE LISTING OR PROGRAM

Not Applicable

BACKGROUND OF THE INVENTION

1. Field of Invention

This invention relates to beds, mattresses and box springs and, more specifically, to a device for correcting a sagging bed.

2. Background of the Invention

When a bed becomes worn, it tends to sag in the middle greatly reducing posture support and comfort. A sagging bed results from deformation of the mattress and box spring components during normal use. The volume of the mattress deformation manifests itself as a shallow paraboloid shape. Additionally, the top of a worn mattress experiences degradation in firmness. A sagging mattress can be the source of numerous physical and psychological ailments. Initially, the purchase of a new mattress and box spring can remedy this situation, However, a new bed is expensive and will eventually succumb to sagging through normal use. Many types of prior art have attempted to correct this sagging, each with distinct disadvantages:

a) Bed boards are inserted between the box spring and mattress. However, this merely stiffens the bed and does not address the deformed sagging mattress. Nor, do bed boards address mattress top firmness degradation.

b) Inserts, composed of foam or, pads of wadding or stuffing, are inserted between the box spring and mattress such as U.S. Pat. No. 3,751,742 (1973) to Worley. All of these types of inserts have only a singular size, thickness and firmness that have cross sections with straight line contours. These straight line contours cause pressure points on the body that greatly reduce comfort. U.S. Pat. No. 1,742,108 (1929) to Taylor discloses a compensating pad that can be placed above or below a worn mattress. Additionally, two of Taylor's pads can be used back to back. However, Taylor's pads have only one size, one thickness and one degree of firmness rendering them unable to correct varying amounts of sagging. Nor, can Taylor's pads provide varying amounts of mattress top firmness correction.

c) One or more inflatable bladders are placed between mattress and box spring such as U.S. Pat. No. 4,745,645 (1987) to McWilliams and U.S. Pat. No. 6,665,898 (2003) to Gordon. This type of device is adjustable but, requires expensive air pumps, hoses, and valves or control mechanisms. Multi-bladder inflatable inserts have stepped cross-sections and straight edges that cause pressure points. The bladders themselves can cause uneven support that has the sensation of "rolling on a beach ball". Also, these bladders can develop leaks thereby negating any support. Nor, do inflatable bladders address mattress top firmness degradation.

d) A mechanical expansion device adjustable by a crank handle is placed between mattress and box spring as discloses in U.S. Pat. No. 2,545,310 (1951) to Rosenberger. This type of device is adjustable but, it is stiff and expensive to manufacture. Additionally, this device only addresses the sag in the longitudinal direction. Nor, does Rosenberger's device address mattress top firmness degradation.

None of the previous art employs a paraboloid shape which would produce even support and eliminate undesirable pressure points. Except the stuffed pad (Worley), no previous art can be used on top of the mattress. However, the stuffed pad is not adjustable and only has one size, one thickness and one firmness setting. None of the previous art has a customizable base size that can be trimmed for non-standard size bedding. Additionally, the degree of mattress sagging varies depending on factors such as age, use, design and size. A solution is need that is adjustable, inexpensive and easy to use for correcting the sag of a mattress and box spring and, can also modify the mattress top firmness.

BACKGROUND OF THE INVENTION—OBJECTS AND ADVANTAGES

Accordingly, several objects and advantages of the present invention are:

a) To provide inexpensive inserts that correct any amount of mattress and box spring sagging.

b) To provide inserts that can variably modify the mattress top firmness.

c) To provide inserts that more closely approximate the shape of the mattress sag volume.

d) To provide inserts with no straight line contours or stepped cross sections that cause uncomfortable pressure points on the human body.

e) To provide non-inflatable inserts that do not require complicated pumps, motors, hoses, valves or control mechanisms.

f) To provide inserts that are easily used, stored and transported.

g) To provide kits of multiple inserts having various thickness, firmness and base size.

h) To provide inserts that can be used in combination with existing bed-boards, orthopedic supports and mattress toppers without interference.

i) To provide inserts for use on non-standard bedding.

j) To provide recyclable inserts.

Further objects and advantages will become apparent from consideration of the ensuing description and drawings.

SUMMARY OF THE INVENTION

According to the present invention, a kit is provided comprising at least three thin foam inserts for placement above and below a worn mattress. The insert top surface approximates a thin paraboloid and the bottom surface is a rectangular flat plane with rounded corners. The longitudinal and lateral cross sections of each insert approximate a thin parabolic arc that is thickest in the center and tapers to a rear knife edge at the periphery. Each kit comprises inserts of various thickness, firmness and base sizes. Any number of inserts are layered in any combination and placed centrally between the box spring and mattress to correct any amount of sagging. Additionally, any number of inserts are layered in any combination and placed centrally on top of a mattress to achieve desired firmness.

BRIEF DESCRIPTION OF THE DRAWINGS

In the drawings, closely related figures have the same number but different alphabetic suffixes.

Figure 1:
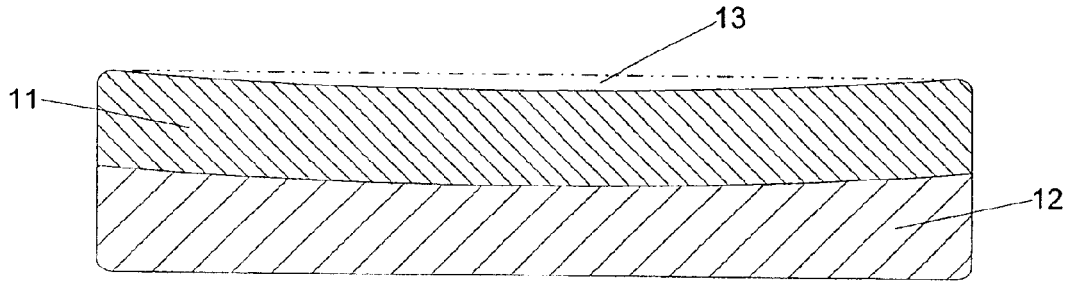
FIG. 1 PRIOR ART
FIG. 1 is a side view of a sagging conventional bed having a box spring and mattress thereon.

| DRAWINGS - Reference Numerals | |
|---|---|
| 11 - mattress | 30 - extra firm insert |
| 12 - box spring | 32 - firm insert |
| 13 - sagging volume | 34 - soft insert |
| 14 - insert (general) | 40 - large base insert |
| 20 - thick insert | 42 - medium base insert |
| 22 - medium thick insert | 44 - small base insert |
| 24 - thin insert | |

DETAILED DESCRIPTION—FIGS. 2A, 2B, 2C AND 3—PREFERRED EMBODIMENT

The present invention is best understood by initial consideration of a conventional bed as shown in FIG. 1. A conventional bed consists of a mattress 11 placed on top of a box spring 12. FIG. 1 shows the general cross sectional shape of sagging volume 13 encountered in a worn bed.

Figure 2A:
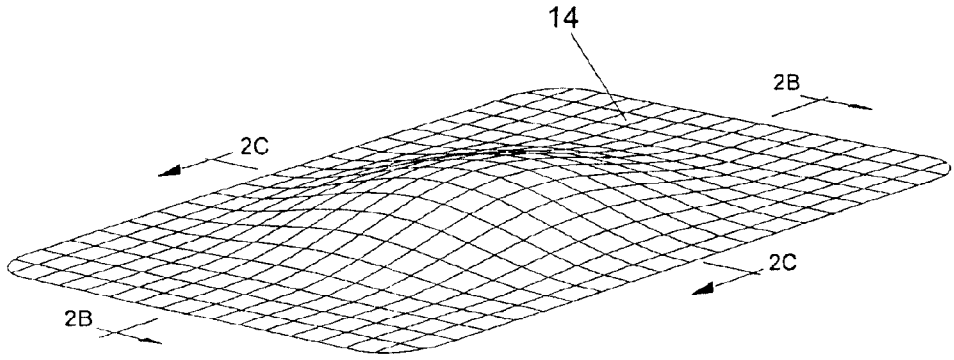
FIG. 2A is a wire-frame perspective view of a single insert of this invention.
Figure 2B:
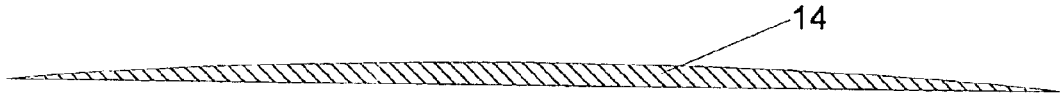
FIG. 2B is a longitudinal sectional view taken on line 2B—2B of FIG. 2A.
Figure 2C:
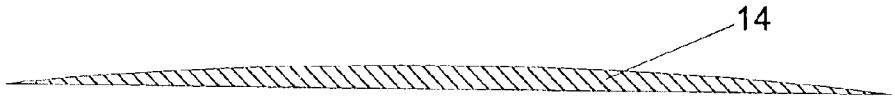
FIG. 2C is a lateral sectional view taken on line 2C—2C of FIG. 2A.
Figure 3:
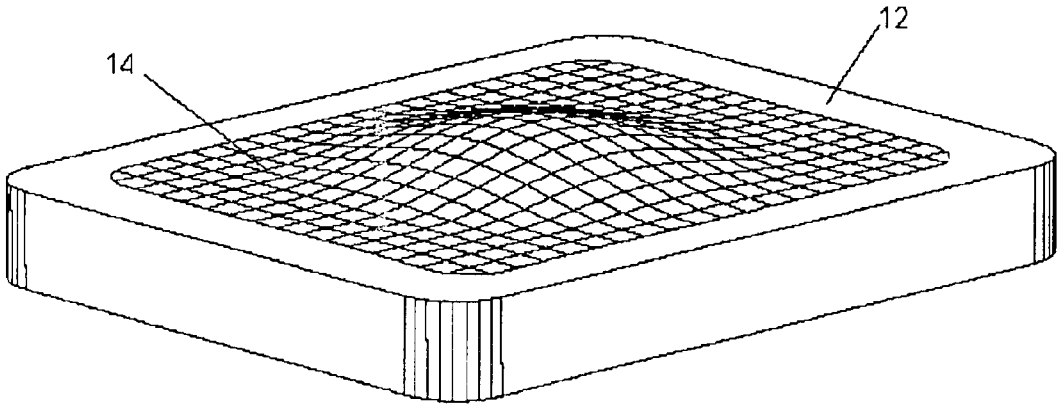
FIG. 3 is a perspective view of a single insert positioned on top of a box spring with mattress removed.

A preferred embodiment of the insert (sheet or pad) of the present invention is illustrated in FIGS. 2A, 2B and 2C. The overall shape of the insert 14 approximates a thin paraboloid as shown in FIG. 2A. The insert 14 has a parabolic cross-section in both the longitudinal and lateral direction as shown in FIGS. 2B and 2C, respectively. The insert cross section is thickest in the center and tapers in a parabolic arc to a near knife edge at all four edges. The insert 14 has a rectangular flat base with rounded corners. FIG. 3 shows the width of the insert 14 is approximately 80% of the box spring 12 width. Similarly, FIG. 3 shows the length of insert 14 is approximately 80% of the box spring 12 length.

For the purpose of description, the numeral 14 refers to a single generic insert. In the following embodiments of the present invention, a kit is supplied with at least three inserts, each differing in thickness, firmness or base size. All numerated inserts of the present invention will have the same general parabolic cross section of insert 14 as shown in FIGS. 2B and 2C. However, specifically numbered inserts will vary in thickness, firmness or base size as detailed in the following embodiments.

Figure 4A:
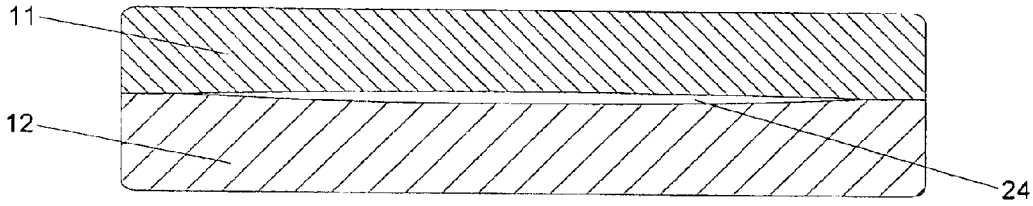
FIG. 4A is a side view of a single variable thickness insert positioned between the box spring and mattress.
Figure 4B:
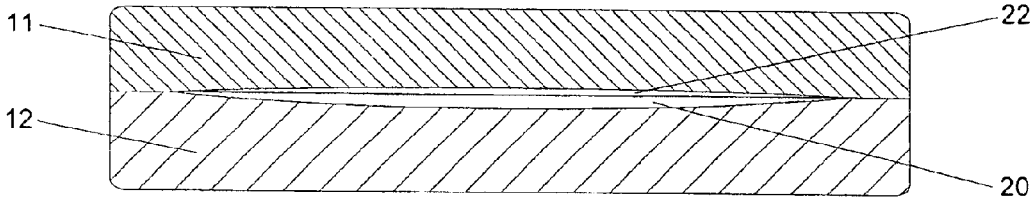
FIG. 4B is a side view of a two variable thickness inserts positioned between the box spring and mattress.
Figure 4C:
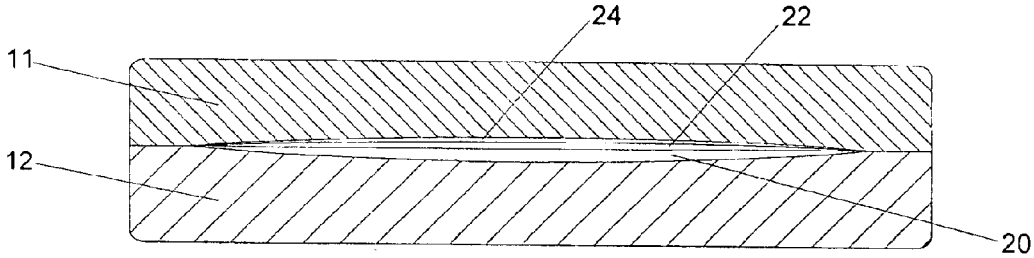
FIG. 4C is a side view of a three variable thickness inserts positioned between the box spring and mattress.

In the preferred embodiment of the present invention, a kit is provided comprising three or more inserts as shown in FIGS. 4A, 4B and 4C. Each insert has the same firmness and base size but, different thickness. As shown in FIG. 4C, insert 20 is the thickest, insert 22 is 50% the thickness of 20 and insert 24 is 50% the thickness of 22. In the preferred embodiment, the inserts are made of resilient foam such as polyurethane. The foam inserts can be manufactured by existing techniques such as hot wire cutting, contour cutting and convolution.

Figure 7A:
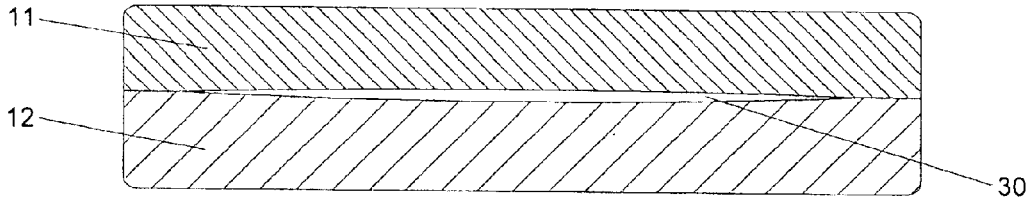
FIG. 7A is a side view of a single variable firmness insert positioned between the box spring and mattress.
Figure 7B:
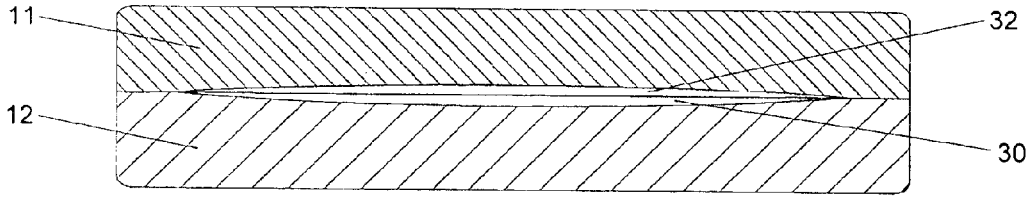
FIG. 7B is a side view of a two variable firmness inserts between the box spring and mattress.
Figure 7C:
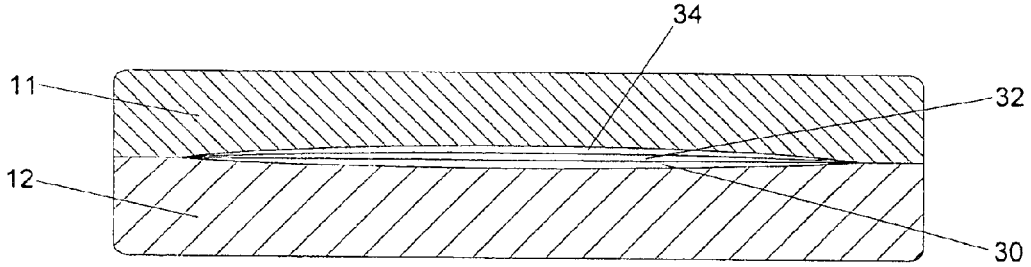
FIG. 7C is a side view of a three variable firmness inserts positioned between the box spring and mattress.

FIGS. 7A, 7B and 7C—Additional Embodiments

In another embodiment of the present invention, a kit is provided comprising three or more inserts as shown in FIGS. 7A, 7B and 7C. Each insert has the same thickness and base size but, different firmness. As shown in FIG. 7C, insert 30 is extra firm, insert 32 is firm and insert 34 is soft.

FIGS. 8, 9A, 9B and 9C—Alternative Embodiments

Figure 8:
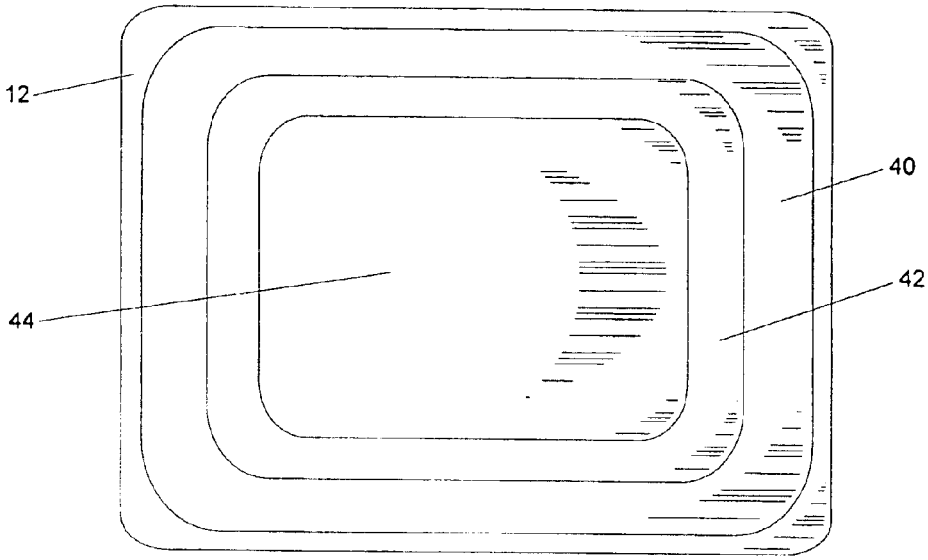
FIG. 8 is a top view of three variable base inserts positioned on top of a box spring with mattress removed.
Figure 9A:
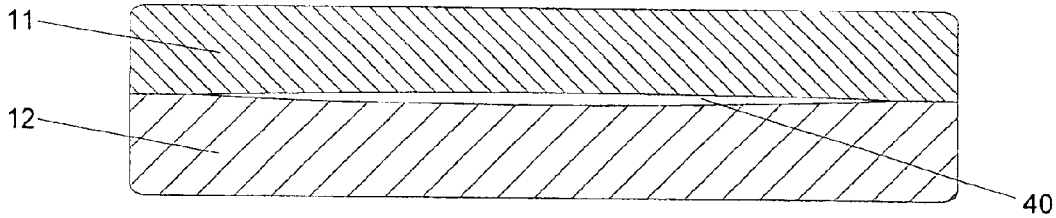
FIG. 9A is a side view of a single variable base insert positioned between the box spring and mattress.
Figure 9B:
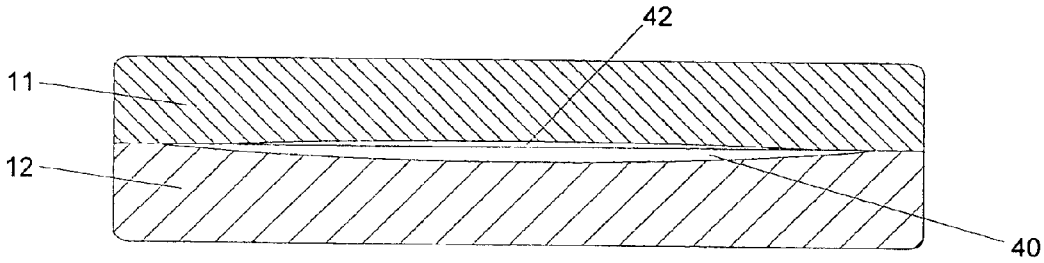
FIG. 9B is a side view of a two variable base inserts positioned between the box spring and mattress.
Figure 9C:
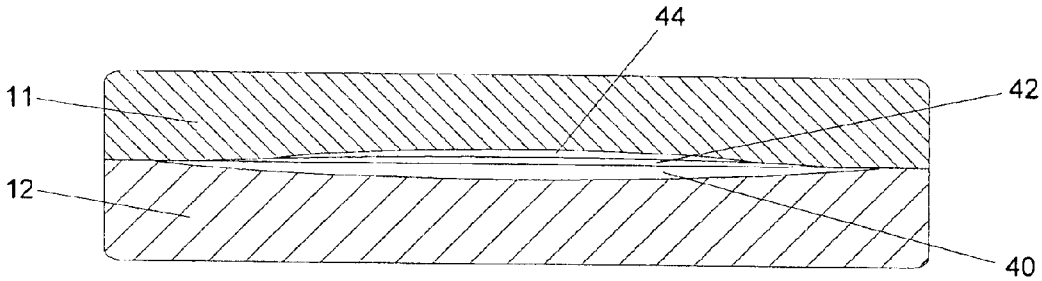
FIG. 9C is a side view of a three variable base inserts positioned between the box spring and mattress.

In another embodiment of the present invention, a kit is provided comprising three or more inserts as shown in FIGS. 9A, 9B and 9C. Each insert has the same thickness and firmness but, different base sizes. As shown in FIG. 8 (top view) and 9C, insert 40 has the largest base area with length and width 80% of the respective mattress length and width. The length and width of insert 42 is 80% the respective length and width of 40 and the length and width of insert 44 is 80% the respective length and width of 42.

Figure 10:
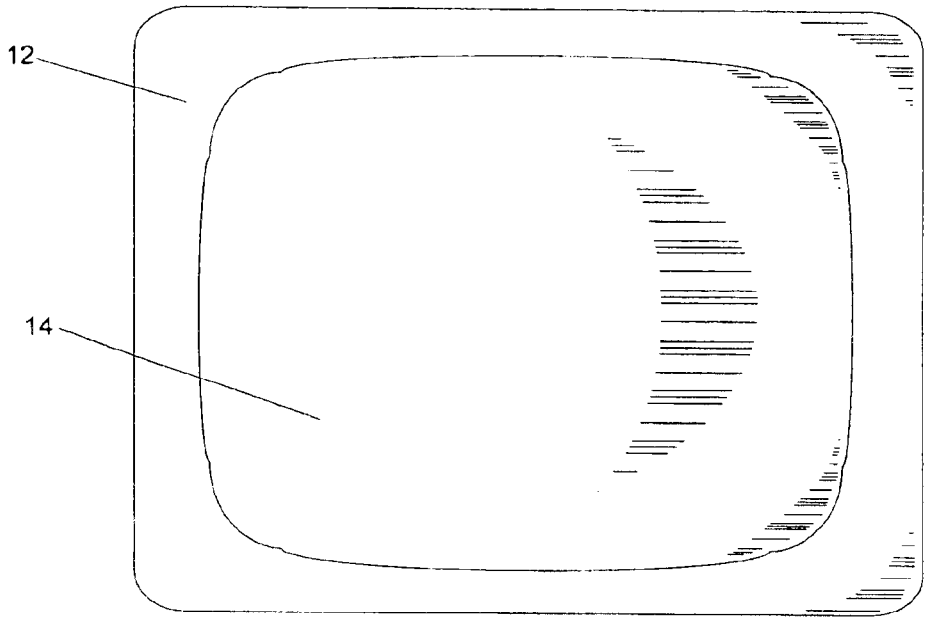
FIG. 10 is a top view of a single insert with curved edges positioned on top of a box spring with mattress removed.

A variation of the present invention has all four peripheral edges of the insert 14 slightly curved as shown in FIG. 10.

Operation—FIGS. 3–10

As shown in FIGS. 3 through 10, all insert embodiments are placed centrally on the box spring or mattress. In the preferred embodiment, FIG. 3 shows the width of the insert 14 is approximately 80% of the box spring 12 width. Similarly, FIG. 3 shows the length of insert 14 is approximately 80% of the box spring 12 length. This leaves a 10% margin on each side. As shown in FIGS. 4A, 4B and 4C, this margin ensures the mattress 11 edges remain in contact with the box spring 12 edges when the inserts are placed between them. This contact prevents the mattress 11 from sliding on the box spring 12. Additionally, the coefficient of friction of the foam insert 14 prevents the mattress 11 from sliding on the box spring 12.

In the preferred embodiment, FIG. 4A shows how minimal mattress sagging is corrected by placing one insert 24 between the box spring 12 and mattress 11. Larger amounts of mattress sagging can be corrected by substituting insert 22 or 20 for insert 24. Even larger amounts of sagging can be corrected by placing any two inserts between the box spring 12 and mattress 11. FIG. 4B shows one possible combination using inserts 20 and 22. However, any combination of two inserts from the kit comprising inserts 20, 22 and 24 can be chosen. The most severe sagging can be corrected by placing all three inserts 20, 22 and 24 between the box spring 12 and mattress 11 as shown in FIG. 4C. The inserts can be layered in any order to achieve desired sag correction.

Figure 5A:
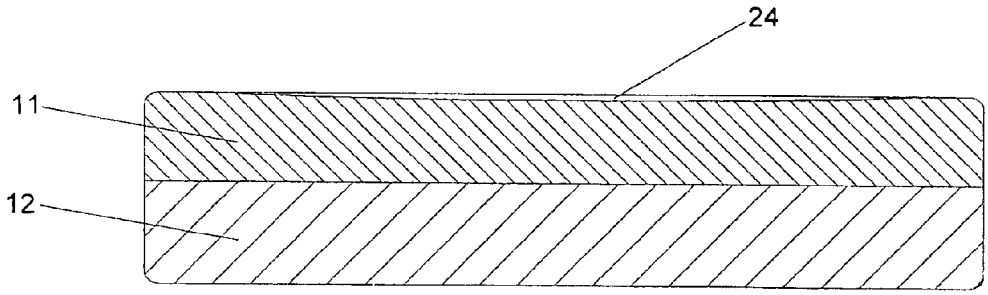
FIG. 5A is a side view of a single variable thickness insert positioned on top of a mattress.
Figure 5B:
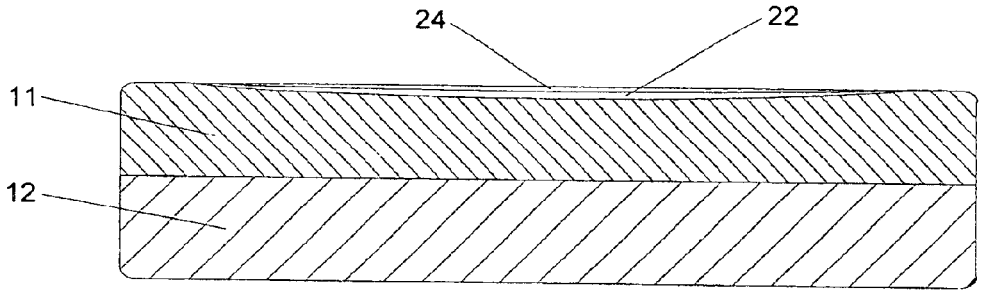
FIG. 5B is a side view of two variable thickness inserts positioned on top of a mattress.
Figure 5C:
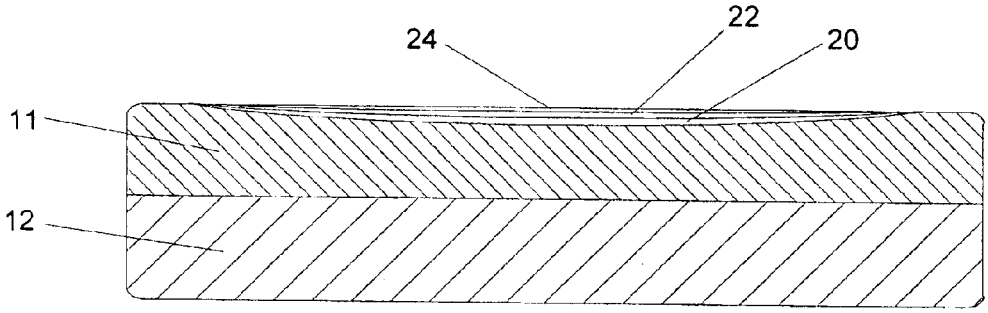
FIG. 5C is a side view of three variable thickness inserts positioned on top of a mattress.

Mattress top firmness is also addressed by this embodiment as shown in FIGS. 5A, 5B and 5C. FIG. 5A shows one insert 24 placed on top of a mattress 11. Alternatively, insert 20 or 22 could be substituted to create the amount of firmness desired. Further firmness adjustments can be achieved by placing any two inserts on top of a mattress 11. FIG. 5B shows one possible combination using inserts 22 and 24. However, any combination of two inserts from the kit comprising inserts 20, 22 and 24 can be chosen. Still further firmness adjustments can be achieved by placing all three inserts 20, 22 and 24 on top of a mattress 11 as shown in FIG. 5C. The inserts can be layered in any order to achieve desired mattress top firmness. The insert are held in place by a fitted sheet.

Figure 6A:
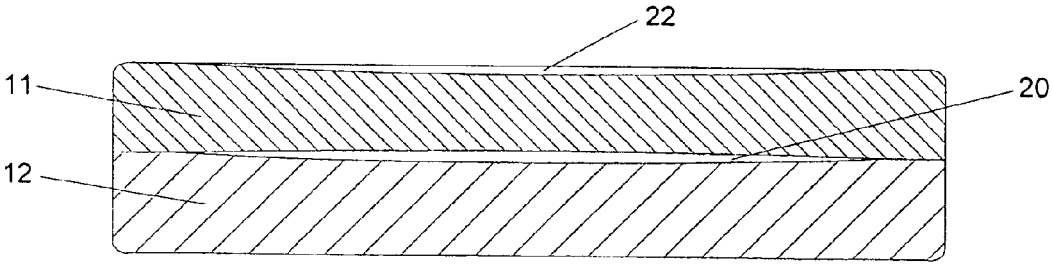
FIG. 6A is a side view of one variable thickness insert positioned on top of mattress and one variable thickness insert between mattress and box spring.
Figure 6B:
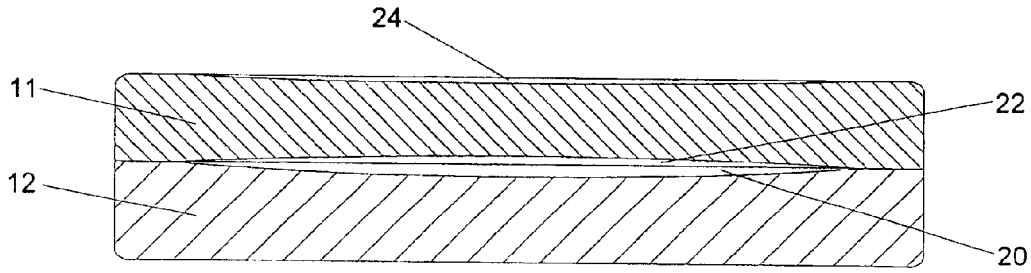
FIG. 6B is a side view of one variable thickness insert positioned on top of mattress and two variable thickness inserts between mattress and box spring.

Additionally, sagging and mattress top firmness are addressed simultaneously by this embodiment as shown in FIGS. 6A and 6B. FIG. 6A shows one insert 22 positioned on top of mattress and one insert 20 between mattress and box spring. Additional amounts of sag correction and mattress top firmness correction can be achieved by arranging the inserts 20, 22 and 24 in various combinations above and below the mattress as suggested by FIG. 6B. The inserts can be layered in any order to simultaneously achieve desired sag correction and mattress top firmness.

In another embodiment, FIG. 7A shows how minimal mattress sagging is corrected by placing insert 30 between the box spring 12 and mattress 11. Larger amounts of mattress sagging can be corrected by substituting insert 32 or 34 for insert 30. Even larger amounts of sagging can be corrected by placing any two inserts between the box spring 12 and mattress 11. FIG. 7B shows one possible combination using inserts 30 and 32. However, any combination of two inserts from the kit comprising inserts 30, 32 and 34 can be chosen. The most severe sagging can be corrected by placing all three inserts 30, 32 and 34 between the box spring 12 and mattress 11 as shown in FIG. 7C. The inserts can be layered in any order to achieve desired sag correction.

Additionally, sagging and mattress top firmness are addressed simultaneously by this embodiment in a manner similar to the preferred embodiment. This can be envisioned by substituting inserts 30, 32 and 34 for inserts 20, 22 and 24, respectively, in FIGS. 5A, 5B, 5C, 6A and 6B. However, the inserts 30, 32 and 34 vary in firmness but, maintain constant thickness and base size.

In still another embodiment, FIG. 9A shows how minimal mattress sagging is corrected by placing one insert 40 between the box spring 12 and mattress 11. Larger amounts of mattress sagging can be corrected by substituting insert 42 or 44 for insert 40. Even larger amounts of sagging can be corrected by placing any two inserts between the box spring 12 and mattress 11. FIG. 9B shows one possible combination using inserts 40 and 42. However, any combination of two inserts from the kit comprising inserts 40, 42 and 44 can be chosen. The most severe sagging can be corrected by placing all three inserts 40, 42 and 44 between the box spring 12 and mattress 11 as shown in FIG. 9C. The inserts can be layered in any order to achieve desired sag correction.

Additionally, sagging and mattress top firmness are addressed simultaneously by this embodiment in a manner similar to the preferred embodiment. This can be envisioned by substituting inserts 40, 42 and 44 for inserts 20, 22 and 24, respectively, in FIGS. 5A, 5B, 5C, 6A and 6B. However, the inserts 40, 42 and 44 vary in base size but, maintain constant thickness and firmness.

Since beds sag at different rates, the inserts can be interchanged and/or replaced as the need arises.

Advantages

From the description above, a number of advantages of my sagging mattress repair inserts become evident:

(a) By combining inserts that vary in thickness, firmness and base size, the user can correct any amount of sagging in a used mattress and box spring.

(b) The inserts also modify the mattress top firmness to desired comfort.

(c) The smooth paraboloid contour of the inserts closely approximates the sagging volume of a used mattress thereby eliminating straight line contours or stepped cross sections of previous art that cause uncomfortable pressure points on the human body.

(d) Unlike inflatable inserts, no complicated pumps, motors, hoses, valves or control mechanisms are required and will not loose support due to leaking bladders.

(e) The use of foam makes the inserts lightweight, inexpensive, easy to used, easily stored and transported.

(f) Existing bed-boards, orthopedic supports and mattress toppers can be used in combination with the inserts without interfering with their intended operation.

(g) Due to the flexibility of the inserts, they can be used on sleeper sofas, futons and other non-traditional bedding.

(h) The use of polyurethane foam makes the inserts 100% recyclable.

Conclusion, Ramifications and Scope

Accordingly, the reader will see that the foam inserts of this invention can be layered in numerous combinations to not only correct a sagging bed but, also modify the mattress top firmness. The flexibility of the insert kit allows a user to "test-sleep" any desired combination of inserts. If the first iteration of insert combinations does not achieve the desired comfort level, the user can try another insert combination until desired comfort is achieved. Any unused inserts from a kit can be easily stored by folding the insert and/or rolling it into a tight tube then bound with a strap or placed in a bag. Additionally, the unused inserts can be stored unfolded under a bed.

Additionally, all mattress topper manufactures require their products be installed on a non-sagging mattress. This precludes the use of mattress toppers on most used mattresses due to inevitable sagging. Therefore, to use mattress topper, a new mattress must be purchase to avoid the mattress topper manufacturer's non-sagging requirement. My inserts would eliminate the sagging of a used mattress thereby allowing use of a mattress topper according to manufacture's requirements.

Although the description above contains many specificities, these should not be construed as limiting the scope of the invention but as merely providing illustrations of some of the presently preferred embodiments of this invention. For example, the incremental changes in insert thickness, firmness and base sizes stated for inserts 20, 22, 24, 30, 32, 34, 40, 42 and 44 above can be expressed in virtually any percentage. Also, the inserts can be composed of other resilient materials.

In another variation of the present invention, a kit is provided comprising three or more inserts that combine various aspects of all embodiments. For example, a kit comprising three or more inserts that possess various combinations of thickness, firmness and base sizes.

In a further variation of the present invention, the arc of the insert cross section could also be circular, elliptical, hyperbolic or other type of curved surface.

Each insert kit is sized for a particular standard size mattress respectively (single, twin, queen and king). However, the inserts can be used for non-standard mattress sizes by simply cutting the closest sized standard insert with scissors. This is easily facilitated by manufacturing the inserts with dotted pattern lines for accurate cutting. Additionally, the inserts can be fitted with fasteners such as Velcro™ to prevent them from sliding.

All embodied kits can have any number of inserts.

The inserts can further be coated, or covered, in such a manner to protect against moisture and deterioration.

Thus the scope of the invention should be determined by the appended claims and their legal equivalents, rather than by the examples given.

I claim:

1. A device for placement above and below a mattress comprising a kit comprising a plurality of inserts, the improvement wherein said insert has a top surface and a bottom surface, wherein said top surface approximates a thin paraboloid and said bottom surface is a flat plane, wherein said top surface and said bottom surface intersect at a periphery having generally rectangular base and rounded corners, wherein said insert has a parabolically arced cross-section in the longitudinal and lateral directions which is thickest in the center and tapers to a near knife edged at all edges of said periphery, wherein said insert has length and width less than said mattress, wherein said insert is composed of resilient foam.

2. The kit of claim 1 wherein a first said insert is thicker than a second said insert and said second insert is thicker than a third said insert.

3. The kit of claim 1 wherein a first said insert is more firm than a second said insert and said second insert is more firm than a third said insert.

4. The kit of claim 1 wherein the base size of the first said insert is larger than the base size of a second said insert and the base size of said second insert is larger than the base size of a third said insert.

5. The kit of claim 1 wherein said inserts vary in thickness, firmness and base size.

6. The insert of claim 1 wherein the four edges of said rectangular base of said insert are curved.

7. The kit of claim 1 wherein said inserts are protected by a waterproof coating.

8. A method of correcting a sagging bed, comprising the steps of:

(a) Placing a device above and below a mattress comprising a kit comprising a plurality of inserts, the improvement wherein said insert has a top surface and a bottom surface, wherein said top surface approximates a thin paraboloid and said bottom surface is a flat plane, wherein said top surface and said bottom surface intersect at a periphery having generally rectangular base and rounded corners, wherein said insert has an arced cross-section in the longitudinal and lateral directions which is thickest in the center and tapers to a near knife edged at all edges of said periphery, wherein said insert has length and width less than said mattress, wherein said insert is composed of resilient foam, (b) providing a sagging bed comprised of said mattress and a box spring, (c) inserting one said insert between said mattress and said box spring, (d) inserting a plurality of said inserts between said mattress and said box spring, (e) placing one said insert on top of said mattress, (f) placing a plurality of said inserts on top of said mattress, (g) inserting a plurality of said inserts between said mattress and said box spring and placing a plurality of said inserts on top of said mattress, whereby plurality of said inserts of said kit are layered in any combination between said mattress and said box spring and/or placed on top of said mattress such that said sagging bed is corrected and said mattress top firmness is modified.

9. The method of claim 8 wherein a first said insert is thicker than a second said insert and said second insert is thicker than a third said insert.

10. The method of claim 8 wherein a first said insert is more firm than a second said insert and said second insert is more firm than a third said insert.

11. The method of claim 8 wherein the base size of the first said insert is larger than the base size of a second said insert and the base size of said second insert is larger than the base size of a third said insert.

12. The method of claim 8 wherein said inserts vary in thickness, firmness and base size.

13. The method of claim 8 wherein said inserts are congruent to a negative mold of the sagging volume of said mattress.

14. A device for placement above and below a mattress comprising a kit comprising a plurality of inserts, the improvement wherein said insert has a top surface and a bottom surface, wherein said top surface is a longitudinally and laterally oriented arc and said bottom surface is a flat plane, wherein said top surface and said bottom surface intersect at a periphery having generally rectangular base and rounded corners, wherein said insert has an arced cross-section in the longitudinal and lateral directions which is thickest in the center and tapers to a near knife edged at all edges of said periphery, wherein said insert has length and width less than said mattress, wherein said insert is composed of resilient foam.

15. The kit of claim 14 wherein a first said insert is thicker than a second said insert and said second insert is thicker than a third said insert.

16. The kit of claim 14 wherein a first said insert is more firm than a second said insert and said second insert is more firm than a third said insert.

17. The kit of claim 14 wherein the base size of the first said insert is larger than the base size of a second said insert and the base size of said second insert is larger than the base size of a third said insert.

18. The kit of claim 14 wherein said inserts vary in thickness, firmness and base size.

19. The insert of claim 14 wherein the four edges of said rectangular base of said insert are curved.

20. The kit of claim 14 wherein said inserts are protected by a waterproof coating.

* * * * *